United States Patent [19]

Du Castel

[11] Patent Number: 5,066,947

[45] Date of Patent: Nov. 19, 1991

[54] VERY LARGE SIZE DISPLAY SCREEN

[76] Inventor: Francois Du Castel, 103 Avenue Félix Faure, 75015 Paris, France

[21] Appl. No.: 302,625

[22] Filed: Jan. 26, 1989

[30] Foreign Application Priority Data

Feb. 3, 1988 [FR] France ..... 88 01251

[51] Int. Cl.[5] ..... G08B 5/00; G09F 19/12

[52] U.S. Cl. ..... 340/815.31; 340/795; 340/815.1; 40/546; 40/547

[58] Field of Search ..... 340/795, 762, 815.03, 340/815.1, 815.31; 40/546, 547; 350/96.24, 96.27; 362/227, 800, 812

[56] References Cited

U.S. PATENT DOCUMENTS

| | | | |
|---|---|---|---|
| 3,744,048 | 7/1973 | Triechel | 340/815.31 |
| 3,766,376 | 10/1973 | Sadacca et al. | 40/547 |
| 3,786,500 | 1/1974 | Fiorletta et al. | 40/547 |
| 4,279,089 | 7/1981 | Murakami | 40/547 |
| 4,296,562 | 10/1981 | Sanborn | 340/815.31 |
| 4,525,711 | 6/1985 | Gery | 340/795 |

FOREIGN PATENT DOCUMENTS

| | | | |
|---|---|---|---|
| 3303917 | 8/1984 | Fed. Rep. of Germany . | |
| 2573896 | 5/1986 | France . | |
| 1433327 | 4/1976 | United Kingdom . | |
| 1499121 | 1/1978 | United Kingdom | 40/547 |

OTHER PUBLICATIONS

The article "10th International Optical Computing Conference", Massachusetts, Apr. 6–8 1983, pp. 55–58, W. E. Glenn.

*Primary Examiner*—Ulysses Weldon
*Assistant Examiner*—M. Fatahiyar
*Attorney, Agent, or Firm*—Pearne, Gordon, McCoy & Granger

[57] ABSTRACT

A very large display screen which is made up of a curtain of suspended optical fibers of different lengths. The fibers are illuminated by light emitting diodes. The light emitting diodes are grouped in triads emitting the three primary colors to produce a colored display.

3 Claims, 2 Drawing Sheets

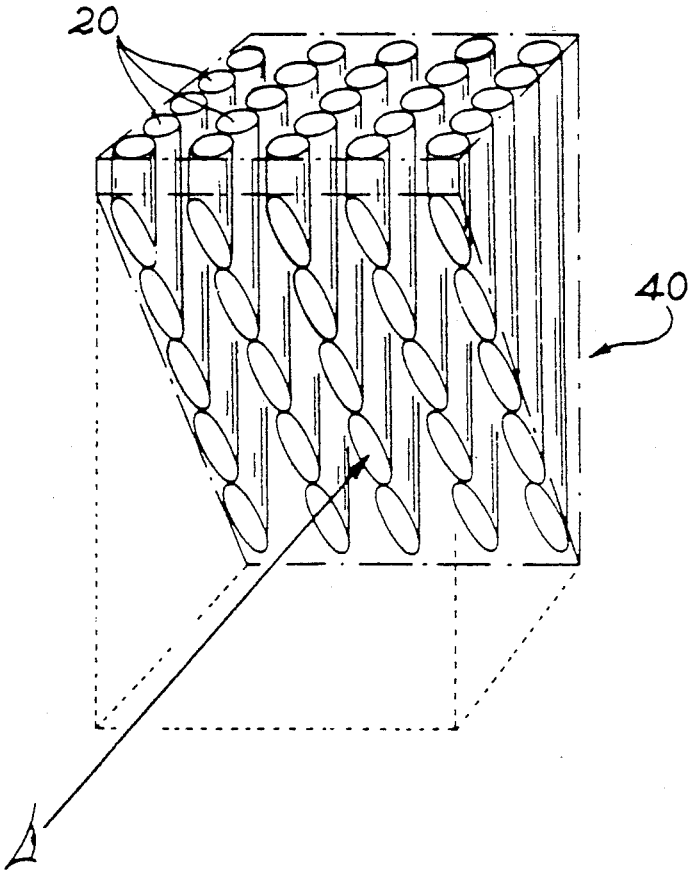
FIG. 2A
FIG. 2B
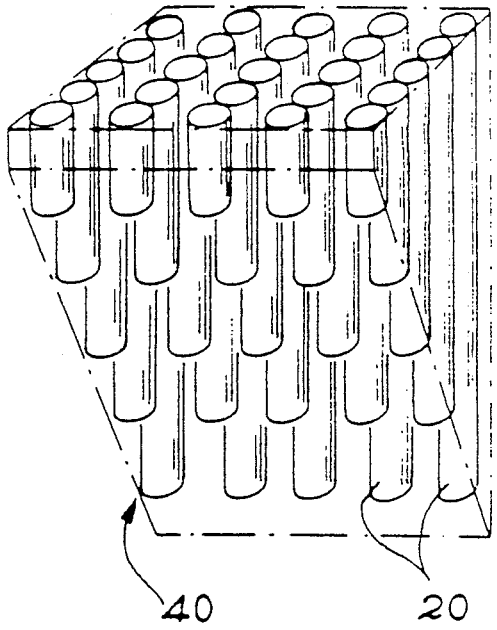
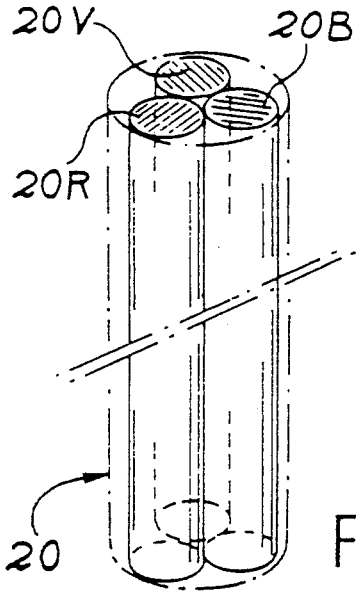
FIG. 3

VERY LARGE SIZE DISPLAY SCREEN

BACKGROUND OF THE INVENTION

The present invention relates to a display screen having very large dimensions. It is used in the production of screens employed for decorative, information, animation and similar purposes for use in the open air, public places, etc.

For a considerable time cinematographic projection screens have been known and for some time also so-called "giant" screens permitting the projection of television pictures. Mosaics of video screens have also appeared.

Sophisticated technology using liquid crystals, discharge tubes, etc. have also made it possible to produce large surface flat screens.

Although satisfactory from certain respects, these procedures suffer from the disadvantage of not making it possible to produce very large screens, i.e. having a side length of several dozen meters. Screens of the projection type are unsatisfactory through lack of brightness and definition, whereas flat screens are unsatisfactory due to addressing problems.

SUMMARY OF THE INVENTION

The present invention aims at obviating these disadvantages. It therefore proposes a screen, whose principle and structure make it possible to achieve considerable display surfaces, e.g. 50×50 meters or more. Despite these large dimensions, the brightness and definition of the picture are excellent and the complexity of the control system remains acceptable.

According to the invention this result is achieved by a screen constituted by a curtain of suspended optical fibers of different lengths, said lengths being such that the free ends of the fibers define a surface constituting the display surface, while the other ends of the fibers are optically coupled to the same number of light emitting diodes.

Although it is possible to have display surfaces with any random shape (e.g. concave, convex, spherical cup-shaped, etc), preference is usually given to a planar surface. The latter is preferably rectangular or square, but could also be circular or eliptical.

According to an advantageous embodiment, the light emitting diodes are constituted by treads emitting the primary colors, such as red, green and blue. The display is then in colors.

BRIEF DESCRIPTION OF THE DRAWINGS

The invention is described in greater detail hereinafter relative to non-limitative embodiments and the attached drawings, wherein show:

FIGS. 2A to 2B an elementary display zone.

FIG. 3 a triad of optical fibers guiding light in three primary colors.

DETAILED DESCRIPTION OF THE PREFERRED EMBODIMENT

Figure 1:
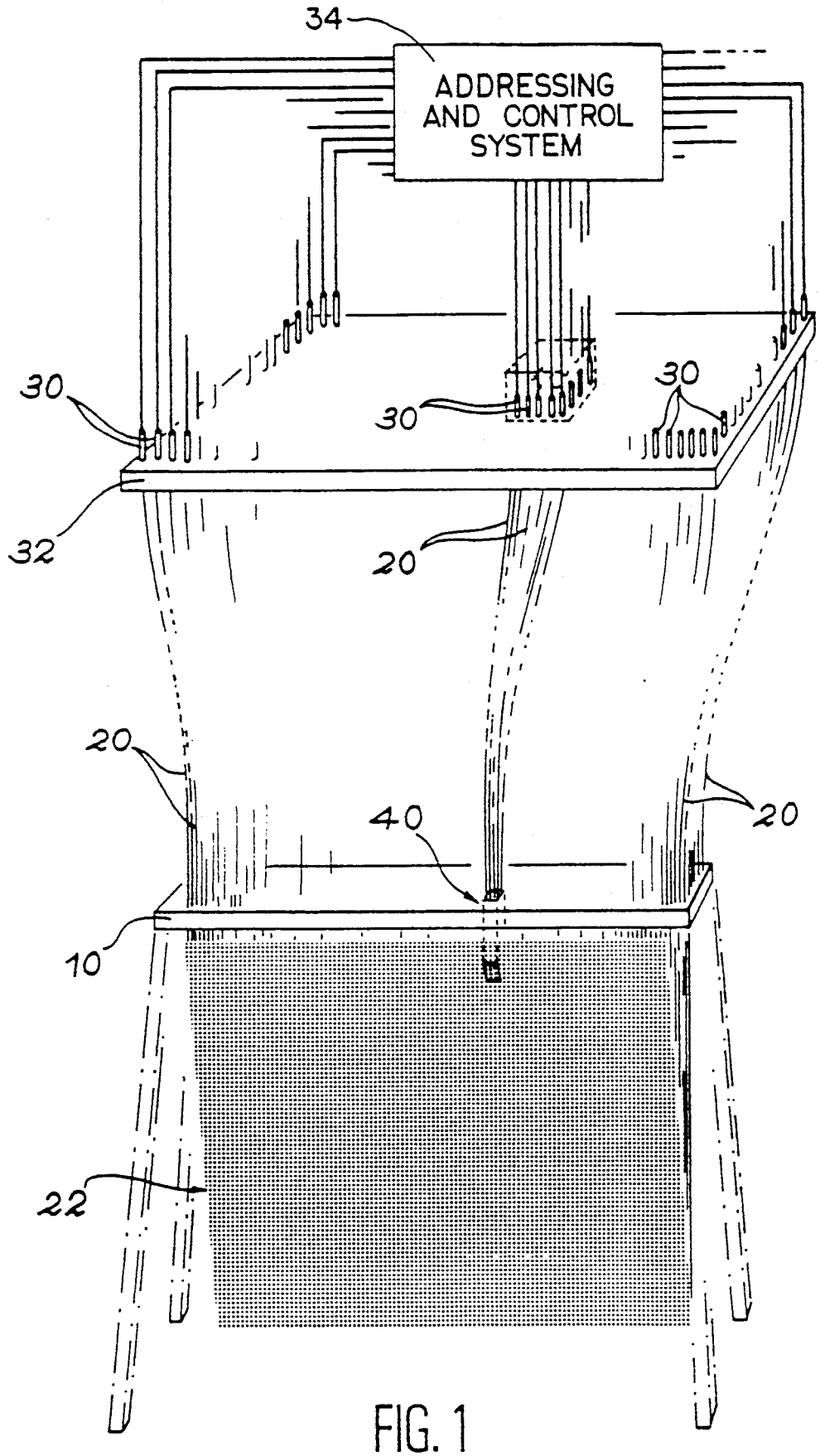
FIG. 1 a screen according to the invention.

The display screen shown in FIG. 1 comprises a horizontal rectangular frame 10 on which are suspended optical fibers 20. These fibers have different lengths, so that their free ends define a rectangular surface 22 constituting the display surface.

The optical fibers are also optically coupled to light emitting diodes 30, which in the illustrated example are combined in a frame 32. These diodes are electrically connected to an addressing and control system 34.

It is naturally not necessary to combine all these diodes in one panel and they could also be grouped into several groups distributed in the vicinity of the screen.

In the illustrated embodiment, the fibers belonging to the same line parallel to the large side of the frame 10 all have the same length. However, the fibers belonging to the same line parallel to the small side of the frame have a length increasing linearly with the depth, the rear fibers being longer than the front fibers.

For example, the display square can have side lengths of 50 meters. The depth of the screen (length of the small side of frame 32) can be 3 meters.

Such a screen can be broken down into elementary display zones, each of which is able to form a picture element. Such an elementary zone carries the reference 40 in FIG. 1 and is shown in greater detail in FIGS. 2A to 2B.

Each elementary zone can comprise 3000 points requiring 3000 diodes. An elementary zone can have a side length of 0.5 m. Its depth can be 30 mm. Thus, there are 100×100, i e. 10,000 unitary zones of this type for the complete screen. Therefore the system requires 10,000×3,000, i.e. 30 million light emitting diodes.

As it is necessary to cut the fibers at the time of producing the screen to given them the appropriate length, it is possible to bevel them to favour a directivity towards the observation point and this is illustrated in FIG. 2A. However, they could also be cut along a straight section plane (FIG. 2B).

FIG. 3 shows how the fibers are grouped into triads 20R, 20V and 20B. These fibers guide quasi-monochromatic light, respectively red, green and blue coming from the appropriate diodes. Thus, a luminance and a chrominance correspond to each triad of points of an elementary zone. The control of the system of diodes associated with an elementary zone makes it possible to give the picture element corresponding thereto the desired luminance and chrominance. Certain diodes may not be excited for low luminance levels or for chrominances corresponding to pure primary colors.

In the case of diodes able to emit a power of 1 mW, each picture element corresponds to a power between 0 and 3 W. The power can reach 30 kW for the complete screen.

Preferably plastic optical fibers are used and have a diameter of 0.5 mm. Thus, 1,000 triads of such fibers are grouped per elementary zone. About 30 triads occupy the 30 mm available in depth (therefore they are quasi-contiguous) and the 500 mm available in length.

With fibers weighing approximately 25 g per 100 m, the total screen weight is 19 tonnes. However, this weight can be produced if the fibers are suspended on two or more frames placed at different heights instead of a single frame (such as 10 in FIG. 1). Thus, the second frame can be e.g. located at mid-height. The normally longer rear fibers are then reduced by half.

The curtain of fibers constituting the screen can be mounted so as to float freely, so that in the case of wind the image or picture moves slowly, which is desirable. However, if a fixed picture or image is desired, it is always possible to arrange one or more e.g. plastic transparent films in or around the curtain of fibers.

On the basis of said description, it is apparent that the screen has a modular character, firstly relative to an elementary zone and then on an overall basis. Thus, as a function of needs, it is possible to combine several screens like that of FIG. 1 either in juxtaposed manner to increase the width, or in superimposed manner to increase the height. In particular, it is possible to produce screens in the form of a vertical strip for messages in a language written from top to bottom (e.g. Japanese).

I claim:

1. A display device for very large size displays comprising:

at least a solid horizontal rectangular frame having front and rear sides and two lateral sides;

optical fibers having first and second ends, said first ends being secured to said frame so that said optical fibers are suspended from said frame, said second ends being freely suspended, the fibers belonging to a vertical plane parallel to said front and rear sides of said frame having an equal length and the fibers belonging to a vertical plane parallel to said lateral sides having a length increasing from front to rear, said second freely suspended ends defining a large substantially plane display screen;

light emitting diodes located above said frame and optically coupled to said first ends of said optical fibers; and an addressing and control system connected to said light emitting diodes.

2. A very large size display device according to claim 1, wherein said screen is a rectangle having two large size sides parallel to said front and rear sides of said frame.

3. A very large display device according to claim 1, wherein the optical fibers are plastic fibers.

* * * * *

UNITED STATES PATENT AND TRADEMARK OFFICE

CERTIFICATE OF CORRECTION

PATENT NO. : 5,066,947

DATED : November 19, 1991

INVENTOR(S) : Francois Du Castel

It is certified that error appears in the above-identified patent and that said Letters Patent is hereby corrected as shown below:

Column 4, line 5, "plane" should be --planar--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*